US006753816B1

(12) United States Patent
Apostolos

(10) Patent No.: US 6,753,816 B1
(45) Date of Patent: Jun. 22, 2004

(54) DUAL BAND/DUAL MODE MEANDER LINE ANTENNA

(75) Inventor: John T. Apostolos, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/324,552

(22) Filed: Dec. 20, 2002

(51) Int. Cl.[7] ..... H01Q 1/38
(52) U.S. Cl. ..... 343/700 MS; 343/744
(58) Field of Search ..... 343/700 MS, 741, 343/742, 828, 829, 846, 848, 744

(56) References Cited

U.S. PATENT DOCUMENTS 5,790,080 A 8/1998 Apostolos
6,204,819 B1 * 3/2001 Hayes et al. ..... 343/702
6,323,814 B1 * 11/2001 Apostolos ..... 343/744
6,373,446 B2 * 4/2002 Apostolos ..... 343/797
6,452,462 B2 9/2002 Lo
6,518,929 B1 * 2/2003 Gilmore ..... 343/725

* cited by examiner

*Primary Examiner*—Tan Ho

(57) ABSTRACT

A dual band/dual mode meander line antenna which include a ground plane, and a pair of substantially vertical radiating surface elements disposed substantially parallel to one another and perpendicular to ground plane. A generally horizontal top plate element is in substantially parallel relations to the ground plane. A wide band meander line element is capacitively connected to the horizontal top radiating element. At least one narrow band meander line element connected to the top horizontal radiating element.

20 Claims, 2 Drawing Sheets

DUAL BAND/DUAL MODE MEANDER LINE ANTENNA

BACKGROUND OF THE INVENTION

1. Field of the Invention

The present invention relates to antennas and more particularly to meander line antennas.

2. Brief Description of Prior Developments

In the past, efficient antennas have typically required structures with minimum dimensions on the order of a quarter wavelength of the radiating frequency. These dimensions allowed the antenna to be excited easily and to be operated at or near a resonance, limiting the energy dissipated in resistive losses and maximizing the transmitted energy. These antennas tended to be large in size at the resonant wavelength.

Further, as frequency decreased, the antenna dimensions increased in proportion. In order to address the shortcomings of traditional antenna design and functionality, researchers developed the meander line loaded antenna. One such is disclosed in the U.S. Pat. No. 5,790,080 for Meander Line Loaded Antenna, which is hereby incorporated herein by reference. This patent describes an antenna that includes one or more conductive elements for acting as radiating antenna elements, and a slow wave meander line adapted to couple electrical signals between the conductive elements. The meander line has an effective electrical length that affects the electrical length and operating characteristics of the antenna. The electrical length and operating mode of the antenna is readily controlled.

Meander lines are connected between the vertical and horizontal conductors at the gaps. The meander lines are designed to adjust the electrical length of the antenna. In addition, the design of the meander slow wave structure permits lengths of the meander line to be switched in or out of the circuit quickly and with negligible loss, in order to change the effective electrical length of the antenna. This switching is possible because the active switching devices are always located in the high impedance sections of the meander line. This feature keeps the current through the switching devices low and results in very low dissipation losses in the switch, thereby maintaining high antenna efficiency.

The basic antenna can be operated in a loop mode that provides a "figure eight" coverage pattern. Horizontal polarization, loop mode, is obtained when the antenna is operated at a frequency such that the electrical length of the entire line, including the meander lines, is a multiple of full wavelength. The antenna can also be operated in a vertically polarized, monopole mode, by adjusting the electrical length to an odd multiple of a half wavelength at the operating frequency. The meander lines can be tuned using electrical or mechanical switches to change the mode of operation at a given frequency or to switch frequency using a given mode.

The meander line loaded antenna allows the physical antenna dimensions to be reduced significantly while maintaining an electrical length that is still a multiple of a quarter wavelength of the operating frequency. Antennas and radiating structures built using this design in the region where the limitation on their fundamental performance is governed by the Chu-Harrington relation:

$$\text{Efficiency}=FV_2Q$$

where:

Q=Quality Factor $V_2$=Volume of the structure in cubic wavelengths

F=Geometric Form Factor (F=64 for a cube or a sphere)

Meander line loaded antennas achieve the efficiency limit of the Chu-Harrington relation while allowing the antenna size to be much less than a wavelength at the frequency of operation. Height reductions of 10 to 1 can be achieved over quarter wave monopole antennas, while achieving comparable gain.

U.S. Pat. No. 6,323,814 for Wide Band Meander Line Loaded Antenna is also incorporated herein by reference. This reference discloses a meander line loaded antenna which provides a wide instantaneous bandwidth. A first planar conductor is substantially parallel to the ground plane and is separated from the first planar conductor by a gap. A meander line interconnects the first and second planar conductors. The antenna may be arranged in opposed pairs, and also as two orthogonally opposed pairs for enabling circular polarization.

SUMMARY OF INVENTION

The present invention is a dual band/dual mode meander line antenna which includes a ground plane and a pair of substantially vertical radiating surface elements disposed substantially parallel to one another and perpendicular to the ground plane. A generally horizontal top plate element is in substantially parallel relation to the ground plane. A wide band meander line element is capacitively connected to the horizontal top radiating element. At least one narrow band meander line element connected to the top horizontal radiating element.

BRIEF DESCRIPTION OF THE DRAWINGS

The present invention is further described with reference to the accompanying drawings, wherein.

DETAILED DESCRIPTION OF THE PREFERRED EMBODIMENT

Figure 1:
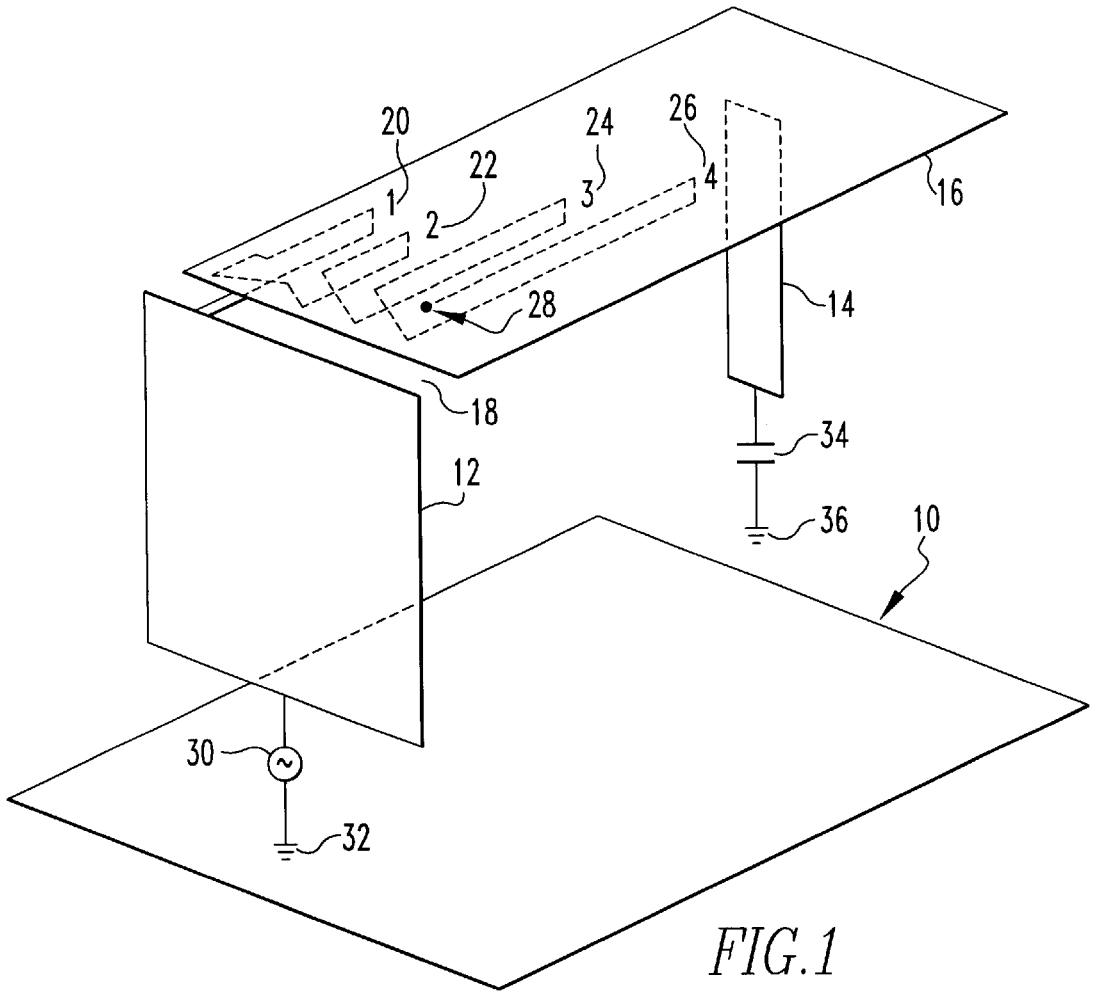
FIG. 1 is a perspective view of a preferred embodiment of the antenna of the present invention.
Figure 2:
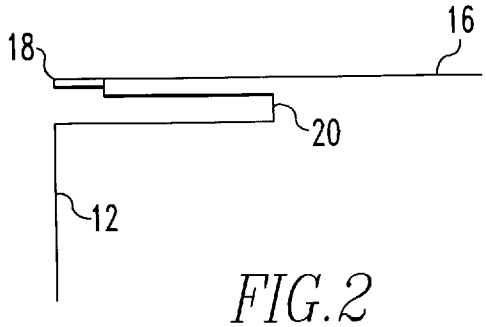
FIG. 2 is a schematic view of the capacitive coupling between the wide band meander line and the top plate element in the antenna shown in FIG. 1.

Referring to FIGS. 1 and 2, in the antenna of the present invention there is a ground plane 10. Vertical plate 12 which is a vertical radiating surface element extends upwardly from the ground plane 10. Vertical plate 14 which is also a vertical radiating surface element also extends upwardly from ground plane 10 in parallel relation to vertical plate 12.

There is also a horizontal plate 16 which is a horizontal radiating surface element which is superimposed over the vertical plate 12 and the vertical plate 14. Between vertical plate 12 and horizontal plate 16 there is an air gap 18. There is also a wide band meander line element 20 which is capacitively coupled to horizontal plate 16 through air gap 18. A suitable wide band meander line element 20 is disclosed in U.S. Pat. No. 6,323,814. Wide band meander line element 20 is connected in series to narrow band meander line element 22. Narrow band meander line element 22 is connected in series to narrow band meander line element 24. Narrow band meander line element 24 is connected in series to narrow band meander line element 26.

Narrow band meander line element 26 is connected to horizontal plate 16 at point 28. A suitable narrow band meander line element 22, 24 and 26 is shown in U.S. Pat. No. 5,790,880.

Figure 3:
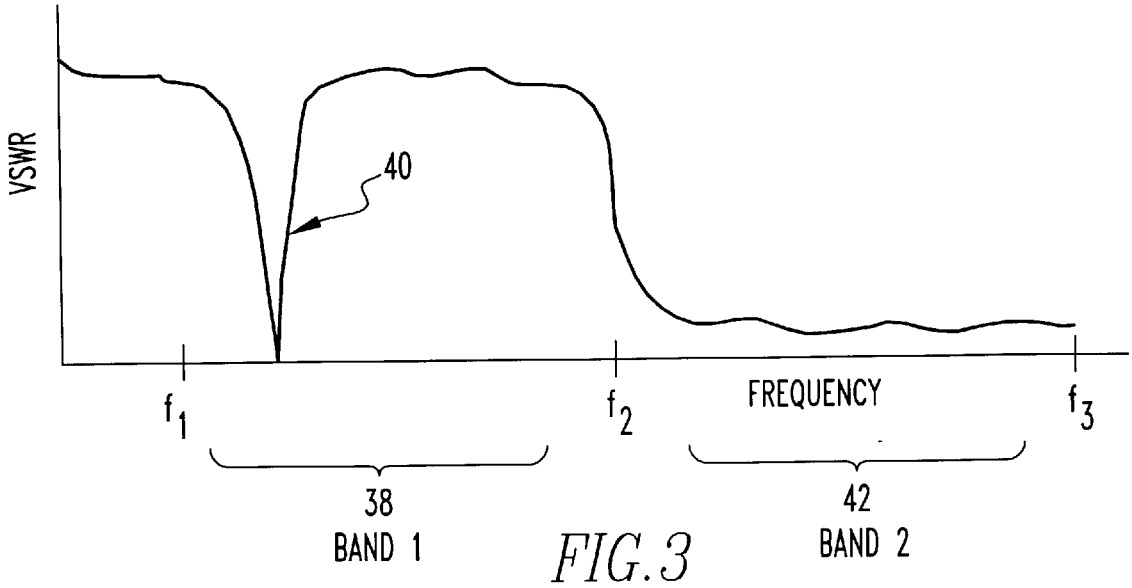
FIG. 3 is a graph of VSWR vs. frequency in a preferred embodiment of the present invention.

Referring to FIG. 3., it will be seen that in the net response of the antenna shown in FIGS. 1–2, there is a first band 30 from frequency f1 to f2 with a tunable responsance 32 which may be accomplished by tuning meander line elements 22, 24 and 26. There is also a second band 34 from frequency f2 to f3. This indicates that this antenna is a dual band/dual mode.

It will be understood that if the horizontal plate 16 is in a triangular shape that two pairs of such triangular antennas as described above can be connected at their vertices to form bow-tie elements as is described in U.S. Pat. No. 6,373,446, the contents of which are incorporated herein by reference.

It will be appreciated that an antenna has been described which allows for the combination of a wide band meander line antenna and the narrow band meander line antenna into a common volume with both wide band narrow band, tunable modes simultaneously available.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A dual band/dual mode meander line antenna comprising:

a ground plane;

a pair of substantially vertical radiating surface elements disposed substantially parallel to one another and perpendicular to said ground plane;

a generally horizontal top radiating surface element disposed substantially in parallel relation to said ground plane;

a wide band meander line element capacitively connected to the horizontal top radiating surface element; and at least one narrow band meander line element connected to the top horizontal radiating element.

2. The dual band/dual mode meander line antenna of claim 1 wherein the wide band meander line element and the narrow band meander line element are connected in series.

3. The dual band/dual mode meander line antenna of claim 2 wherein there are a plurality of narrow band meander line elements.

4. The dual band/dual mode meander line antenna of claim 3 wherein the wide band meander line element and the narrow band meander line element are connected in series.

5. The dual band/dual mode meander line antenna of claim 1 wherein each of the pair of substantially vertical radiation surfaces is grounded to the ground plane.

6. The dual band/dual mode meander line antenna of claim 5 wherein a power source is interposed between one of said pair of substantially vertical radiation surfaces and the ground plane.

7. The dual band/dual mode meander line antenna of claim 5 wherein a capacitor is interposed between one of said pair of substantially vertical radiation surfaces and the ground plane.

8. The dual band/dual mode meander line antenna claim 1 wherein the horizontal top radiating element is a conductive plate.

9. The dual band/dual mode meander line antenna claim 1 wherein the vertical radiating surface elements are conductive plates or conductive strips.

10. A dual band/dual mode meander line antenna comprising:

a ground plane;

a pair of substantially vertical radiating surface elements disposed substantially parallel to one another and perpendicular to said ground plane;

a generally horizontal top radiating surface element disposed in substantially parallel relation to said ground plane;

a wide band meander line element capacitively connected to the horizontal top radiating surface element; and a plurality of narrow band meander line elements connected in series to the wide band meander line element and to each other and to the top horizontal radiating surface element.

11. The dual band/dual mode meander line antenna of claim 10 wherein each of the pair of substantially vertical radiation surfaces is grounded to the ground plane.

12. The dual band/dual mode meander line antenna of claim 11 wherein a capacitor is interposed between one of said pair of substantially vertical radiation surfaces and the ground plane.

13. The dual band/dual mode meander line antenna of claim 10 wherein a power source is interposed between one said pair of substantially vertical radiation surfaces and the ground plane.

14. The dual band/dual mode meander line antenna claim 10 wherein the horizontal top radiating element is a conductive plate.

15. The dual band/dual mode meander line antenna claim 10 wherein the vertical radiating surface elements are conductive plates or conductive strips.

16. A dual band/dual mode meander line antenna comprising:

a ground plane;

a pair of substantially vertical radiating surface elements disposed substantially parallel to one another and grounded to said ground plane;

a generally horizontal top radiating surface element disposed in substantially parallel relation to said ground plane;

a wide band meander line element capacitively connected to the horizontal top radiating surface element;

a plurality of narrow band meander line elements connected to the top horizontal radiating element; and a capacitor interposed between one of said vertical radiating surface elements and the ground plane.

17. The dual band/dual mode meander line antenna of claim 16 wherein a power source is interposed between one of said pair of substantially vertical radiation surfaces and the ground plane.

18. The dual band/dual mode meander line antenna of claim 16 wherein the narrow band meander line elements are connected in series to each other and to the wide band meander line element.

19. The dual band/dual mode meander line antenna of claim 16 wherein the horizontal top radiating element is a conductive plate.

20. The dual band/dual mode meander line antenna claim of 16 wherein the vertical radiating surface elements are conductive plates or conductive strips.

* * * * *